United States Patent [19]

Schimmel

[11] 4,030,694

[45] June 21, 1977

[54] COMPOSITE CONCRETE WALL FORM UNIT WITH A SPECIAL TRANSITION BOLT

[75] Inventor: Vernon R. Schimmel, Arlington Heights, Ill.

[73] Assignee: Symons Corporation, Des Plaines, Ill.

[22] Filed: July 14, 1976

[21] Appl. No.: 705,086

[52] U.S. Cl. ..... 249/196; 249/47; 249/189; 249/192; 249/219 R; 85/1 L; 151/68

[51] Int. Cl.² ..... E04G 9/04; E04G 17/04; E04G 11/08

[58] Field of Search ..... 249/40, 44, 45, 47, 249/187, 188, 189, 191, 192, 193, 196; 85/1 L; 151/68

[56] References Cited

UNITED STATES PATENTS

| | | | |
|---|---|---|---|
| 1,129,144 | 2/1915 | Venable | 249/189 X |
| 1,491,397 | 4/1924 | Haugsjaa | 249/192 X |
| 2,763,911 | 9/1956 | Rumble | 249/192 X |
| 2,837,807 | 6/1958 | McGraw | 249/192 |
| 2,862,277 | 12/1958 | Hillberg | 249/192 |
| 2,863,207 | 12/1958 | Davis et al. | 249/192 X |
| 2,948,046 | 8/1960 | Imonetti | 249/196 |
| 2,976,597 | 3/1961 | Elam | 249/47 |
| 2,994,120 | 8/1961 | Bowden | 249/196 |
| 3,067,479 | 12/1962 | Schimmel | 249/192 X |
| 3,246,871 | 4/1966 | Bowden | 249/192 X |
| 3,414,230 | 12/1968 | Brosseau | 249/193 |
| 3,762,678 | 10/1973 | Thornton | 249/193 |

*Primary Examiner*—J. Howard Flint, Jr.
*Attorney, Agent, or Firm*—Norman H. Gerlach

[57] ABSTRACT

A composite concrete wall form unit or assembly consisting of three metal-clad panels connected together in edge-to-edge relationship, the medial panel embodying a plywood facing with a rectangular metal-reinforcing or backing frame, such medial panel constituting a prefabricated fill-in panel for making up an odd dimension which exists between two adjacent outer panels. Such outer panels are of a larger size and likewise are prefabricated in such a manner that they possess a common plywood facing which extends across the plywood facing of the smaller medial panel in face-to-face relationship and thus bridges the odd dimension. A special and novel transition bolt is used for connecting each side rail of the reinforcing frame of the medial panel to the adjacent side rail of the adjacent outer panel.

12 Claims, 4 Drawing Figures

COMPOSITE CONCRETE WALL FORM UNIT WITH A SPECIAL TRANSITION BOLT

The present invention relates generally to concrete wall forms and has particular reference to a concrete wall form of the type which comprises a pair of upstanding spaced apart sides for receiving poured wet concrete therebetween for wall-forming purposes, each side being in the form of a composite unit and embodying a series of rectangular prefabricated panels which are arranged in edge-to-edge and upstanding relationship, each panel consisting of a rectangular plywood facing and a metal-reinforcing or backing frame. For convenience of description herein, such panels will be referred to as metal-clad panels. Apart from their longitudinal (vertical) and transverse (horizontal) dimensions, metal-clad panels are manufactured in different sizes, which is to say that the top, bottom, and side rails of their reinforcing frames are of different gauge metal stock. For example, Symons Corporation of Des Plaines, Ill. has for many years manufactured and sold a steel-clad panel which is known in the trade as a "Steel-Ply" panel wherein the rectangular plywood panel facing is of the three-ply variety and the rectangular reinforcing frame is constructed of appropriate gauge steel stock. Symons Corporation also manufactures and sells another steel-clad panel which is commonly known as a "Versiform" panel wherein the plywood facing is of the five-ply variety and the reinforcing frame is constructed of a much heavier gauge steel stock. The width of the top, bottom, and side rails of the reinforcing frame of a Versiform panel in a direction normal to the plywood facing is also considerably greater than is the width of the corresponding top, bottom, and side rails of the reinforcing frame of a Steel-Ply panel. Moreover, in a Steel-Ply panel, the three-ply panel plywood facing is set in a continuous marginal recess in the reinforcing frame, whereas in a Versiform panel, the five-ply plywood panel facing is not set in a marginal recess, but instead, is placed directly against the front or inner edges of the top, bottom, and side rails of its reinforcing frame.

It frequently happens that when a particular concrete wall form is constructed, in the main, from the larger Versiform panels, an odd dimension is left between two adjacent Versiform panels. This is the case because Versiform panels are made with but few variations in width. Steel-Ply panels on the other hand are made in a wide variety of different widths. Consequently, situations often arise where a Steel-Ply panel of a particular size or width will match the width of the odd dimension that must be made up in connection with a wall form employing Versiform panels. However, the fastening facilities which are currently available for connecting Steel-Ply panels to each other, or those which are available for connecting Versiform panels to each other are not suitable for connecting a Steel-Ply panel to a Versiform panel for fill-in use and, therefore, it has been necessary to devise special fill-in arrangements whenever such an odd dimension is encountered in the formation of a concrete wall form of the type under consideration. Another and equally important limitation which has prevented the use of a Steel-Ply panel as a fill-in panel is the fact that the non-recessed plywood facings of the two flanking Versiform panels and the recessed plywood facing of the medial Steel-Ply panel, as heretofore explained, are not conducive to panel facing continuity, the three-ply plywood facing of the Steel-Ply panel being set back on the order of ¾ of an inch, which is the normal thickness of the five-ply plywood facing of a Versiform panel.

The present invention is designed to overcome both of these limitations that are attendant upon the use of a conventional Steel-Ply panel as a fill-in panel for a concrete wall form which is made up primarily of Versiform panels. Accordingly, insofar as the fastening facilities for effecting a connection between a Steel-Ply panel and an adjacent Versiform panel are concerned, the present invention affords a novel transition bolt and nut assembly which is capable of application to the registering but not similarly shaped openings which are ordinarily provided in the side rails of both the reinforcing frames of the Steel-Ply and the adjacent Versiform panels, such bolt and nut assembly, when properly applied to the two panels, serving securely and efficiently to clamp the adjacent or abutting frame side rails together. Insofar as the establishment of panel continuity between the plywood facing of the Steel-Ply panel and the panel facings of the two adjacent Versiform panels is concerned, the present invention contemplates the provision of a novel assembly of the three panels wherein a common five-ply plywood facing is provided for the reinforcing frames of both Versiform panels, such common plywood facing bridging the odd dimension that is filled-in with the three-ply plywood facing of the Steel-Ply panel and also fitting directly against the last-mentioned facing. Stated otherwise, the completed Steel-Ply panel including its three-ply plywood facing is employed structurally as a fill-in member for the odd dimension void or space, while the common plywood facing for the two Versiform panels establishes the continuous fill-in portion of the wall form side against which the wet concrete is poured. By such an arrangement, no alteration or modification of the Steel-Ply panel need be resorted to in order to adapt it to its fill-in use, nor is any alteration to the two Versiform panels necessary other than to equip them with the common five-ply plywood facing.

The provision of a composite three-panel assembly or unit such as has briefly been outlined above, and possessing the stated advantages, constitutes one of the principal objects of the present invention. Another and equally important object is the provision of a novel transition bolt as also briefly outlined above and having facilities whereby it will accommodate the slots or openings which are ordinarily formed in the side rails of the reinforcing frames of both the Steel-Ply and the Versiform panels and effect positive clamping of the frame side rails of adjacent panels together.

Various other objects and advantages of the invention not at this time enumerated will readily suggest themseleves as the nature of the invention is better understood from a consideration of the following detailed description.

The invention consists in the several novel features which are hereinafter set forth and are more particularly defined by the claims at the conclusion hereof.

In the accompanying single sheet of drawings forming a part of this specification, one illustrative embodiment of the improved composite three-panel concrete wall form unit or assembly and two embodiments of the associated special transition bolt are illustrated.

In these drawings:

FIG. 1 is a fragmentary outside perspective view of a portion of a concrete wall form illustrating the manner in which the side rails of the reinforcing frame of a conventional Steel-Ply panel are operatively connected to the side rails of the reinforcing frames of a pair of adjacent conventional Versiform panels by utilization of the transition bolt of the present invention, the assembly of three panels constituting a novel fill-in concrete wall form unit;

Figure 1:
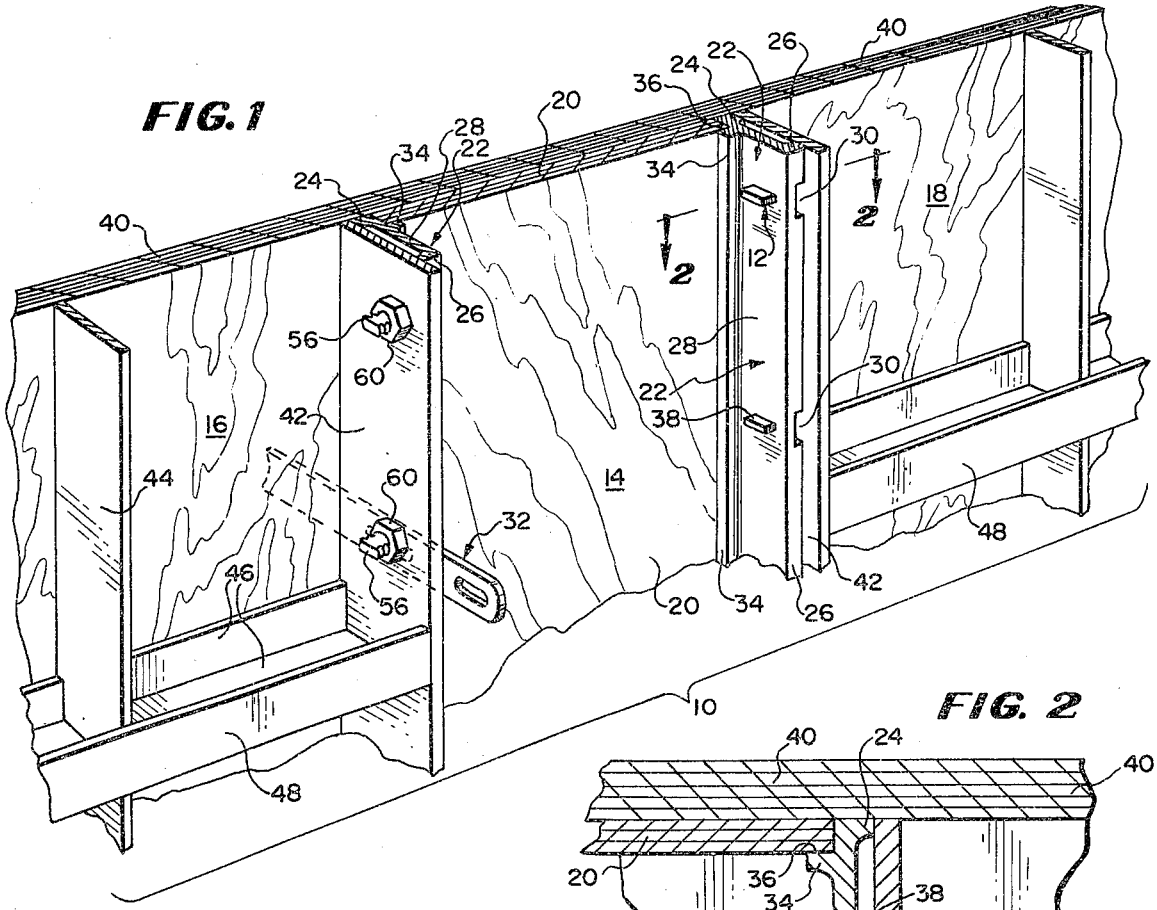

Referring now to the drawings in detail and in particular to FIG. 1, the novelty of the present invention is two-fold and consists of a special type of composite concrete wall form unit or assembly which is fragmentarily shown throughout the drawings and is designated in its entirety by the reference numeral 10, and also a special type or transition bolt which is designated by the reference numeral 12 and by means of which a plurality of wall form panels having different shape or size characteristics may be secured together in operative relationship to establish the composite concrete wall form unit or assembly 10.

Briefly, the composite concrete wall form unit or assembly 10 of the present invention embodies a conventional Steel-Ply panel which is joined in edge-to-edge relationship to the adjacent side rails of the reinforcing frames of a pair of metal-clad Versiform type panels, there being one of the last-mentioned panels on each side of the Steel-Ply panel. The metal-clad panels are provided with a common panel facing, all in a manner and for purposes that will become clear when the nature of the invention is better understood.

Before entering into a description of the specific nature of the composite concrete wall form unit or assembly 10, it is deemed pertinent to point out that the word or term metal-clad as employed herein, as well as in the accompanying claims, refers to any concrete wall form panel which embodies a rectangular plywood or other facing, together with a rectangular or marginal reinforcing frame of steel or other suitable metal. The Steel-Ply panel which is mentioned above is actually, in itself, a steel-clad panel but is referred to herein as a Steel-Ply panel in order to distinguish it more readily from the metal-clad Versiform type panels on opposite sides thereof. It is also referred to as a Steel-Ply panel because it is of a more or less specific nature which, as previously stated, constitutes a concrete wall form panel which has long been manufactured and sold by Symons Corporation of Des Plaines, Ill. On the other hand, the two metal-clad panels on the opposite sides of the Steel-Ply panel may vary widely, the only criterion being that they each include a panel facing which is carried by a rectangular or marginal reinforcing frame of steel or other suitable metal.

The central or medial Steel-Ply panel is designated in its entirety by the reference numeral 14, while the two metal-clad panels at the side thereof are, respectively, designated by the reference numerals 16 and 18. All three of the panels 14, 16 and 18 are prefabricated panels in that they are assembled or put together at the factory rather than in the field.

The illustrated Steel-Ply concrete wall form panel 14 consists of a rectangular plywood facing 20 of the three-ply variety and has a marginal or rectangular steel reinforcing frame applied to the rear or outer side of the facing 20, the latter including vertical and horizontal side rails or frame bars, only the vertical side rails 22 being illustrated in the drawings. Specifically, the vertical side rails 22 are in the form of structural steel members which are generally of shallow U-shape cross section and each includes spaced apart, parallel, vertically extending marginal ribs 24 and 26 and a connecting base or web portion 28. At vertically spaced regions along each vertical side rail 22, the ribs 24 and 26 are notched as at 30 in order to accommodate the adjacent end portions of conventional tie rods at selected levels, only one such tie rod 32 being illustrated in the drawings hereof. On the sides of the side rail web portions 28, which are opposite the ribs 24 and 26, there are formed shallow vertically extending ribs 34 which define vertically extending grooves 36 in the front or inner marginal portions of the side rails 22 of the reinforcing frame for reception therein of the side marginal portions of the three-ply plywood facing 20. The web portions 28 of the side rails 22 have formed therein rectangular horizontally extending slots 38 and these are in horizontal register with the notches 30 and are for reception therethrough of conventional connecting bolt and wedge assemblies by means of which adjacent Steel-Ply concrete wall form panels may be connected together in a concrete wall form consisting of all Steel-Ply panels. The slots 38 are generally vertically spaced on 12 inch centers in the usual manner of Steel-Ply panel construction. The Steel-Ply panel 14 may have associated therewith horizontal frame bars or struts of angle shape design, such frame bars extending between the side rails 22 at appropriate levels and welded thereto. No such frame bars or struts are illustrated in the drawings hereof, but for a fuller understanding of the nature of a conventional Steel-Ply panel, its associated frame bars or struts, and also of its use in connection with a tie rod bolt and wedge clamping assemblies, reference may be had to U.S. Pat. No. 2,948,045, granted on Aug. 9, 1960, and entitled "TIE ROD ASSEMBLY FOR CONCRETE WALL FORMS AND CONE THEREFOR." The entire disclosure of such patent is hereby incorporated in and made a part of the present specification insofar as it is consistent with the present disclosure.

Since the illustrated Steel-Ply panel 14 of the composite concrete wall form unit or assembly 10 is not connected to an adjacent Steel-Ply panel but rather to a different form of metal-clad panel, the slots 38 are not functional except at the particular selected locations where tie rods like the tie rod 32 are to be used.

Although, as previously stated, the transition bolt 12 may be employed for connecting a Steel-Ply panel such as the panel 14 to a wide variety of other metal-clad panels, the particular metal-clad panels 16 and 18 which have been selected for illustration in the drawings hereof are of a type which, like the Steel-Ply panel 14, is manufactured and sold by Symons Corporation under the trade name or designation Versiform. Because of the shape characteristics of a Versiform concrete wall form panel wherein the rectangular reinforcing frame for the plywood panel is appreciably wider in the transverse direction of its various frame members than are the side rails 22 of the rectangular reinforcing frame of the Steel-Ply panel 14, and because of the fact that the plywood panel facing of a Versiform panel is not set in recesses such as the grooves 36 in the front or inner marginal portions of the side rails 22 of the reinforcing frame of the Steel-Ply panel 14, it is not feasible to connect a conventional Versiform panel to a Steel-Ply panel so that the inner sides or faces of their respective panel facings extend in coplanar fashion. The reason for this is because accurate alignment of the facings of adjacent concrete wall form panels would entail precision alignment by highly skilled labor and great difficulty would be encountered in effecting a perfect seal against concrete seepage at the lines of juncture between adjacent panels, all as will become more readily apparent when the nature of the metal-clad Versiform panels 16 and 18 is better understood. Accordingly, the composite concrete wall form unit or assembly 10 of the present invention utilizes only the steel reinforcing or backing frames of the two Versiform panels 16 and 18 and, in order to span the distance between the two spaced apart frames, a common five-ply panel facing 40 is associated with both of such frames and bridges the Steel-Ply panel 14. As shown in FIG. 1 of the drawings, such facing 40 lies flat against and is coextensive with the three-ply plywood facing 20 of the Steel-Ply panel 14. In this position, the vertical side rails 22 of the reinforcing frame of the Steel-Ply panel 14 are disposed in contiguity with the adjacent vertical side rails of the reinforcing frames of the two Versiform panels 16 and 18 and are secured thereto by the transition bolts 12, all in a manner that will be set forth subsequently.

Considering now the nature of the Versiform panels 16 and 18, the rectangular or backing frame of each such panel comprises a plurality of vertical frame members including outside side rails 42 and inside frame members or rails 44, and also top and bottom horizontal frame members or rails (not shown), together with angle-shaped horizontal frame bars or struts 46 which extend between adjacent vertical frame members or rails at appropriate levels in the panel structure. The outside vertical side rails 42 are slightly wider than the inside frame members or rails 44. Horizontal backing strips 48 have their opposite ends abutting against the side rails 42 and their medial regions secured to the outer rear edges of the inside frame members or rails 44.

Figure 2:
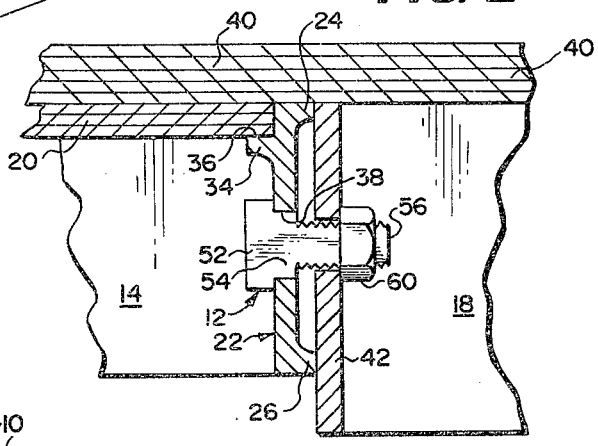
FIG. 2 is an enlarged horizontal sectional view taken on the line 2—2 of FIG. 1 and in the direction of the arrows.

Ordinarily, apart from the novel wall form panel assembly 10 of the present invention, since a Versiform or other similar metal-clad concrete wall form panel other than a Steel-Ply panel 14, is devoid of recesses such as those which are formed by the grooves 26 in the front marginal portions of the side rails 22 of the reinforcing frame of the panel 14, the plywood panel 40 which is associated therewith extends in face-to-edge relationship with respect to each of the vertical frame members including the side rails 42, the vertical or side edges of the plywood panel terminating in the planes of the outer faces of the outer side rails 42. It is desirable in connection with a Steel-Ply concrete wall form panel that the vertical ribs 24 and 26 (see particularly FIG. 2) abut against the outer side rails 42 of any selected adjacent metal-clad panel structure, regardless of whether the latter be of the Steel-Ply or any other type. With a conventional Versiform concrete wall form panel, uninterrupted facing continuity between adjacent panels in the case of one Steel-Ply and one standard Versiform panel could only be attained by causing the edge of the five-ply facing of the Versiform panel to abut against the relatively narrow vertical rib 24 of the adjacent side rail 22 of the Steel-Ply panel. Such a steel-to-wood connection would obviously be impractical and unstable, especially since the side edges of the plywood facing of the Versiform panel is subject to chipping and deformation because it is not protected by metal as is the vertical edges of the plywood facing of a Steel-Ply panel. For this reason, at each of the juncture regions between the Steel-Ply panel 14 and the adjacent Versiform panel reinforcing frame, the rib 24 is caused to abut against the outside face of the adjacent side rail 42 as clearly shown in FIG. 2 and the five-ply plywood facing 40, instead of terminating flush with the edges of the frame structures, is continued across the normal concrete pouring face of the three-ply facing 20 of the Steel-Ply panel 14 and beyond such pouring face where it serves as the panel facings for the reinforcing frames of the Versiform panels 16 and 18. As will become readily apparent as the following description ensues, assembly of the composite concrete wall form unit or assembly 10 is accomplished by first joining the reinforcing frames of the Steel-Ply and Versiform panels together and, after the union thereof has been completed, applying the common five-ply plywood facing 40 across all three reinforcing frames. The common over-all plywood facing 40 is applied to the reinforcing or backing frames of the two Versiform panels 16 and 18 by means of rivets, bolts or the like 50 which pass through the vertical flange of the angle-shaped struts 46, as well as through the plywood facing 40.

As previously indicated, fastening of the vertical side rails 22 of the Steel-ply panel 14 to the vertical outside side rails 42 of the reinforcing frames of the Versiform panels 16 and 18 is effected by means of a plurality of the aforementioned transition bolts 12 which are adapted to pass through selected slots 38 in the side rails 22 of the reinforcing frame of the Steel-Ply panel 14, and also through registering or mating vertically elongated slots 52 in the vertical outer side rails 42 of the reinforcing frames of the Versiform panels 16 and 18, such latter slots being arranged on 12 inch centers as in the case of the slots 38.

Figure 3:
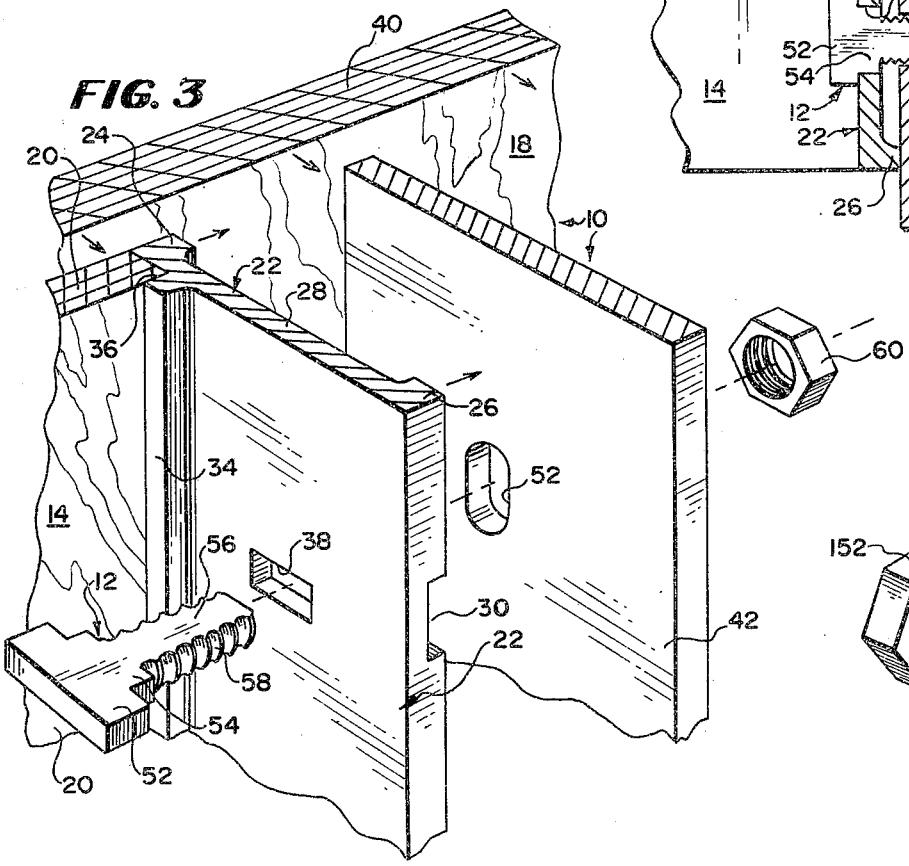
FIG. 3 is an exploded outside perspective view of the structure of FIG. 2.

The transition bolt 12 is best illustrated in FIG. 3 of the drawings and it is comprised of a flat-sided steel member which may be formed of flat bar stock and embodies an enlarged head 52, a shoulder portion 54 of intermediate size, and a reduced shank portion 56. Such shank portion is provided with interrupted helical threads 58 on the narrow edges thereof, the threads on opposite sides of the shank portion extending, in effect, in continuity so that such shank may receive thereover a conventional nut 60 in threaded relationship. The bolt 12 may be manufactured by machining the same from flat bar stock or, alternatively, it may be machined by metal-removing operations in connection with a conventional hex-head type bolt.

In order to erect the composite concrete wall form unit or assembly 10 which is fragmentarily illustrated in FIG. 1 of the drawings, a standard Steel-Ply panel 14 is selected, as also are the reinforcing or backing frames of two Versiform panels such as the identical panels 16 and 18. The completely assembled Steel-Ply panel 14 including its plywood facing 20 is then bolted to the frame of the Versiform panel 18 in the manner illustrated in FIGS. 2 and 3, and that is by bringing one of the vertical side rails 22 of the reinforcing frame of the Steel-Ply panel into contiguity with the corresponding side rail 42 of the reinforcing frame of the Versiform panel 18 so that the various horizontal slots 38 register with the vertical slots 52, both sets of slots being vertically spaced on 12 inch centers. Thereafter, the transition bolts 12 of the present invention are passed through selected pairs of registering slots 38 and 52 and then the nuts 60 are applied to the bolt shanks 58 and tightened in order to clamp the right side rail 22 of the reinforcing frame of the Steel-Ply panel 14 to the adjacent or left side rail 42 of the reinforcing frame of the Versiform panel. It will be noted that it is not necessary to apply a transition bolt 12 to each pair of registering slots 38 and 52, and that the number of employed transition bolts will depend upon the sizes of the two reinforcing frames which are to be connected together. It is also to be noted that the shoulder portions 54 of the transition bolts 12 are shaped correspondingly to and are the same in depth as the horizontally extending rectangular slots 38 in the side rails 22 with the result that when the bolts 12 are in place said shoulder portions completely fill the slots in which they fit and, hence, preclude rotation of the bolts with respect to said side rails 22. After the panels 14 and 18 are bolted together as set forth above, the panels 14 and 16 are bolted together in the same manner.

With the entire Steel-Ply panel 14 including its three-ply plywood facing 20 thus secured to the reinforcing or backing frames of the two Versiform panels 16 and 18, the large five-ply plywood facing 40 is then applied to the frames of the two Versiform panels by riveting or bolting the same to the various right-angle frame bars or struts 46 in such a manner that it bridges the Steel-Ply panel 14 and its central or medial portion lies in face-to-face relationship with the three-ply facing 20 of said panel 14. With the composite concrete wall form unit or assembly 10 thus completed, erection of a concrete wall form may be effected by connecting the wall form side which includes the unit or assembly 10 to a similar opposed concrete wall form side by means of horizontal tie rods such as the tie rod 32.

It is pointed out at this time that the disclosure of FIG. 1 is representative of a fragmentary portion of one side of a concrete wall form which is comprised largely of Versiform panels which are arranged in edge-to-edge relationship, the Steel-Ply panel 14 constituting only a fill-in panel where an odd dimension is to be made up. The unit or assembly 10 which includes a single Steel-Ply panel 14 and two Versiform panels 16 and 18 may, therefore, be regarded as a single composite assembly which is to be used as one unit of the over-all concrete wall form.

Figure 4:
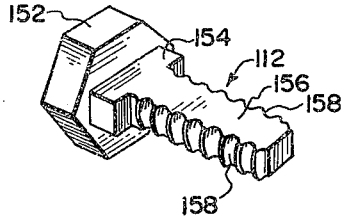
FIG. 4 is a perspective view of a slightly modified form of transition bolt which is capable of substitution for the transition bolt which is shown in FIGS. 1, 2, and 3.

In FIG. 4, a slightly modified form of transition bolt 112 is shown, such bolt being capable of substitution for the previously described bolt 12. The bolt 112 is similar to the bolt 12, the only difference being in the shape of the enlarged bolt head 152 which is hexagonal in nature instead of being flat as in the case of the bolt 12. In view of the similarity between the two bolts 12 and 112, and in order to avoid needless repetition of description, similar reference characters but of a higher order have been applied to the corresponding parts as between the disclosures of FIGS. 4 and 3.

It is to be noted that with either form of transition bolt 12 or 112, the inside surface of the enlarged head 52 or 152, as the case may be, will be drawn hard against the inside face of the adjacent side rail 22 of the reinforcing frame of the Steel-Ply panel 14 when the nut 60 is applied to the reduced flat shank portion of the bolt and then tightened.

The invention is not to be limited to the exact arrangement of parts shown in the accompanying drawings or described in this specification as various changes in the details of construction may be resorted to without departing from the spirit or scope of the invention. For example, although considerable novelty is predicated upon the use of either the transition bolt 12 or the transition bolt 112, novelty is also predicated upon the nature of the composite concrete wall form unit or assembly 10. Therefore, under certain circumstances, it may be deemed expedient to provide horizontally elongated slots in the side rails 42 of the reinforcing frames of the metal-clad panels 16 and 18 in place of the vertically elongated slots 52. In such an instance, adjacent side rails of the unit or assembly 10 may be connected together by bolt and wedge assemblies similar to those shown and described in aforementioned U.S. Pat. No. 2,948,095. The use of such bolt and wedge assemblies will not destroy the essential features of the unit or assembly 10 wherein the medial panel 14 preserves its own plywood facing 20 and also shares the over-all common plywood facing 40. Furthermore, it is within the scope of the present invention to utilize the bolts 12 or 112 and to adapt them for use with reaction wedges by slitting the shank portions thereof. In such an instance, the openings 38 in the side rails 22 would remain rectangular while the openings 52 in the side rails 42 would be made circular. Therefore, only insofar as the invention is particularly pointed out in the accompanying claims is the same to be limited.

Having thus described the invention what I claim asnew and desire to secure by Letters Patent is:

1. In a concrete wall form, a composite fill-in panel unit comprising three rectangular upstanding metal-clad panels arranged in edge-to-edge relationship and including a medial panel and a pair of outside panels, each of said panels embodying a rectangular facing and a rectangular reinforcing frame including opposed parallel vertical side rails, the side rails of said panels being provided with vertically spaced pairs of opposed bolt-receiving openings at different horizontal levels, the side rails of adjacent panels abutting each other, fastening bolts projecting through registering openings in the side rails of abutting panels, and reaction members associated with said fastening bolts for drawing such abutting panels hard against each other, the facings of said outside panels being embodied in a single continuous sheet which bridges the facing of the medial panel and lies flat against the same in face-to-face coextensive relationship and constitutes, in effect, a common and complete facing for the three panels.

2. In a concrete wall form, a composite fill-in panel unit as set forth in claim 1 and wherein the facing of the medial panel is seated within a continuous marginal recess which extends around the reinforcing frame of such panel so that the front face of said facing lies flush with the forward edges of such frame, and the front edges of all of the reinforcing frames are coplanar.

3. In a concrete wall form, a composite fill-in panel unit as set forth in claim 2 and wherein the rear face of the common facing bears coextensively against the front edges of the three reinforcing frames.

4. In a concrete wall form, a composite fill-in panel unit as set forth in claim 2 and wherein the facing of the medial panel is of the three-ply plywood variety and the common facing is of the five-ply plywood variety.

5. In a concrete wall form, a composite fill-in panel unit as set forth in claim 3 and wherein the reinforcing frame of each outside panel comprises horizontal struts between its side rails, and fastening means are provided for securing said common panel to said horizontal struts.

6. In a concrete wall form, a composite fill-in panel unit as set forth in claim 5 and wherein said fastening means constitutes the sole means for securing the common panel in position in said composite fill-in panel unit.

7. In a concrete wall form, a composite fill-in panel unit as set forth in claim 1 and wherein the bolt-receiving openings in the side rails of the medial panel are in the form of horizontal rectangular slots, the openings in the side rails of the outside panels are in the form of vertical elongated slots, and the fastening bolts are provided with enlarged heads, shoulder portions which extend into and are contoured to fit said horizontal slots, and shank portions which extend through said vertical slots.

8. In a concrete wall form, a composite fill-in panel unit as set forth in claim 7 and wherein said reaction members which are associated with said bolts are in the form of nuts which have threaded engagement with said shank portions of the bolts.

9. In a concrete wall form, a composite fill-in panel unit as set forth in claim 8 and wherein said shoulder portions of the bolts substantially fill and have the same depth as the horizontal slots in the side rails of the medial panel.

10. In a concrete wall form, a composite fill-in panel unit as set forth in claim 9 and wherein each bolt is flat-sided and of uniform thickness in the direction normal to its flat sides.

11. In a concrete wall form, a composite fill-in panel unit as set forth in claim 10 and wherein the shank portions of each bolt is formed with interrupted threads designed for mating threaded engagement with a respective nut.

12. In a concrete wall form, a composite fill-in panel unit as set forth in claim 11 and wherein the enlarged head of each fastening bolt is hexagonal.

* * * * *